United States Patent [19]

Kijima

[11] Patent Number: 4,916,424

[45] Date of Patent: Apr. 10, 1990

[54] ELECTRIC PART IN THE FORM OF WINDINGS

[75] Inventor: Seiichi Kijima, Tokyo, Japan

[73] Assignee: Kijima Co., Ltd., Tokyo, Japan

[21] Appl. No.: 336,091

[22] Filed: Apr. 11, 1989

[30] Foreign Application Priority Data

Apr. 26, 1988 [JP] Japan ..... 63-101364

[51] Int. Cl.[4] ..... H01F 27/26; H01F 27/28

[52] U.S. Cl. ..... 336/160; 336/83; 336/192; 336/198; 336/233

[58] Field of Search ..... 336/192, 198, 208, 160, 336/165, 212, 210, 83, 233

[56] References Cited

U.S. PATENT DOCUMENTS 1,360,752 11/1920 Johanneson ..... 336/198 X 4,238,753 12/1980 Bayer ..... 336/198 X 4,257,027 3/1981 Yasuhisa ..... 336/208 X

*Primary Examiner*—Thomas J. Kozma

*Attorney, Agent, or Firm*—Spensley, Horn, Jubas & Lubitz

[57] ABSTRACT

Here is disclosed an electric part in the form of windings particularly suitable to be implemented as a compact transformer comprising an inner bobbin having a cylindrical coil supporting portion around which a coil has been wound, and first and second outer bobbins having respective coil supporting portions square U-shaped in cross-sections and adapted to enclose the inner bobbin from upper and lower sides, wherein, after a coil has been wound around the coil supporting portions of the first and second outer bobbins, one leg of a core having legs is inserted into the coil supporting portion of the inner bobbin.

5 Claims, 7 Drawing Sheets

ELECTRIC PART IN THE FORM OF WINDINGS

BACKGROUND OF THE INVENTION

1. Field of the Invention

The present invention relates to electric part in the form of windings, particularly suitable to be used as a compact transformer.

2. Background Art

Various electric parts in the form of windings are well known, including such part having a plurality of choke coils, the unitary part consisting of multiple transformers and the unitary part comprising choke coil/transformer combination.

Among these parts, the transformer usually comprises a bobbin having a cylindrical coil supporting portion around which a low voltage coil and a high voltage coil are wound and a core having a portion inserted into the inner cavity of said coil supporting portion and the remaining portion axially extending around the coils.

When various coils are wound around a single bobbin, the respective coils may be wound one upon the other directly or lap-wound with interposition of insulating tape so far as a voltage difference between these coils is relatively low. However, if current and voltage values are of anxious levels for safety, the bobbin should be provided with a plurality of insulating flanges so that the respective coils may be independently wound around respective sections of the bobbin defined between each pair of adjacent flanges.

Such arrangement results in the bobbin supporting a plurality of coils which is inconveniently long for miniaturization. Furthermore, the bobbin of prior art is usually provided at opposite ends with terminal pins so that, when the needs of the coil wound around the intermediate section of the bobbin are anchored on these terminal pins, the ends of this coil must be pulled out to the associated terminal pins provided on the opposite ends of the bobbin. This often makes the coil winding operation very troublesome.

SUMMARY OF THE INVENITON

A first object of the present invention is to develop compact electric part in the form of windings adapted to improve electric insulation between a low voltage coil and a high voltage coil.

A second object of the present invention is to develop compact electric part in the form of windings which can be effectively miniaturized and provided independently with a plurlity of coils.

A third object of the present invention is to develop compact electric part in the form of windings having increased number of terminal pins so that handling of coil ends is facilitated.

The objects as set forth above are achieved, in accordance with the present invention, by a compact electric part in the form of windings comprising an inner bobbin having a cylindrical coil supporting portion provided at opposite ends with flanges, terminal pins planted on at least one of said flanges and a coil wound around said coil supporting portion; a first outer bobbin having a coil supporting portion substantially squre U-shaped in its cross-section with its inner side formed to receive a lower portion of said inner bobbin, said coil supporting portion being provided at opposite ends with flanges and insertion holes into which the respective terminal pins of said inner bobbin are inserted, and terminal pins planted on at least one of the flanges; and a second outer bobbin having a coil supporting portion substantially square U-shaped in cross-section with its inner side formed to receive an upper portion of said inner bobbin, said coil supporting portion being provided at opposite ends with flanges; wherein said inner bobbin around which a coil has been wound is enclosed by said first and second outer bobbins connected to each other, a coil is wound around the respective coil supporting portions of these first and second outer bobbins, and one leg of a core having legs is inserted into an inner cavity of the coil supporting portion of the inner bobbin.

BRIEF DESCRIPTION OF THE DRAWINGS

Embodiments of the electric part in the form of windings constructed in accordance with the present invention particularly as implemented as compact transformers are shown by the accompanying drawings in which.

DESCRIPTION OF THE PREFERRED EMBODIMENT

The present invention will be more clearly understood from the following description of embodiments thereof, by way of example, in reference with the accompanying drawings.

Figure 1:
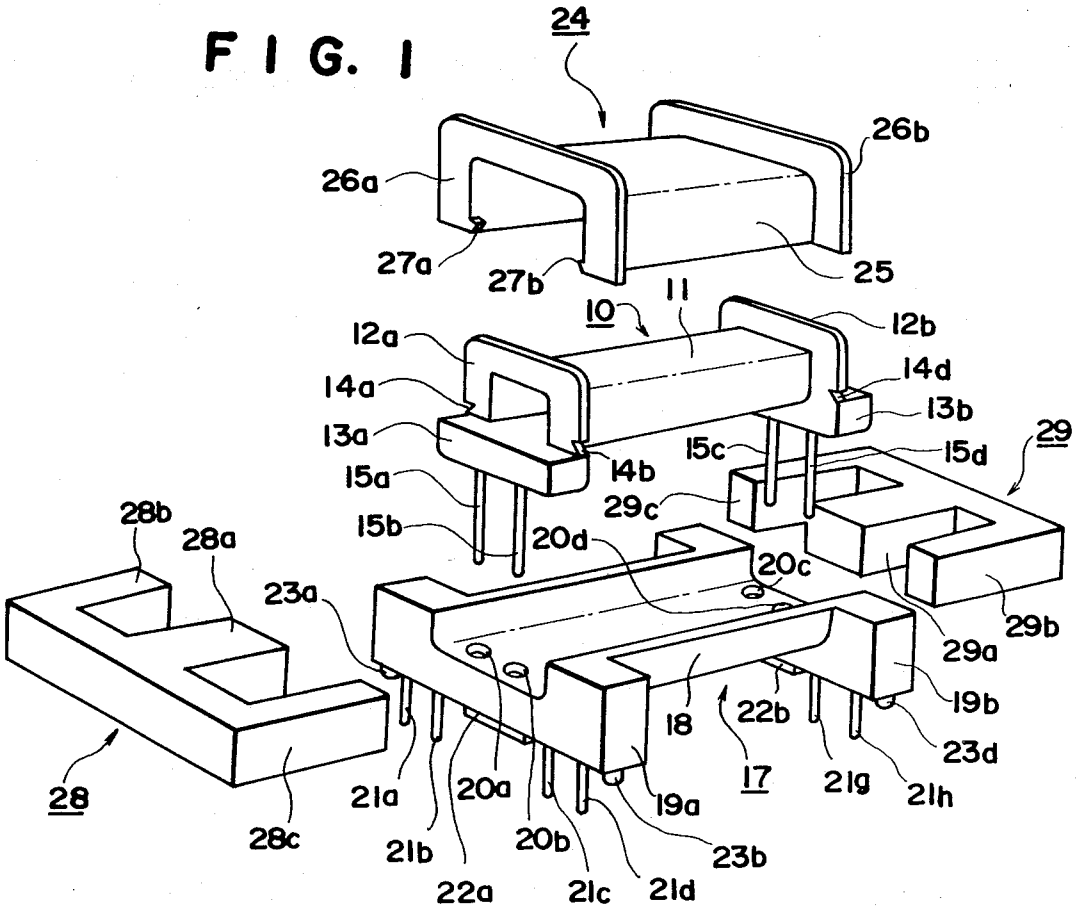
FIG. 1 is an exploded perspective view showing core components and bobbins provided in a compact transformer as a first embodiment of the invention utilizing the E—E core configuration.
Figure 2:
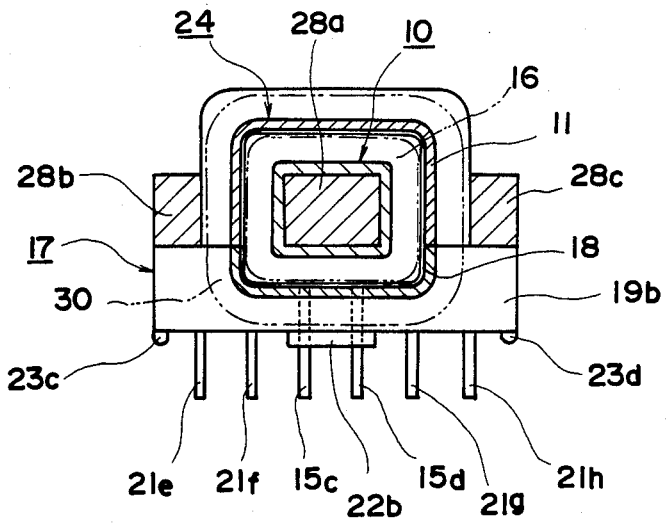
FIG. 2 is a cross-sectional view of this first embodiment.

FIG. 1 is an exploded perspective view of core components of the E—E configuration type and a plurality of bobbins constituting together a compact transformer as a first embodiment of the invention, and FIG. 2 is a crosssectional view of this compact transformer as the first embodiment.

Referring to FIGS. 1 and 2, an inner bobbin generally designated as 10 comprises a cylindrical coil supporting portion 11 which is in turn, provided at opposite ends thereof with substantially square U-shaped flanges 12*a*, 12*b* , and the associated pin supporting flanges 13*a*13*b* being thicker than said flanges 12*a*, 12*b* so as to serve as blocks on which terminal pins 15*a*, 15*b*, 15*c*, 15*d* are planted, as will be described later more in detail. The respective flanges 12a, 12b are provided at laterally opposite sides of their lower ends with V-shaped notches 14a, 14b and 14c, 14d, respectively. Said pin supporting flanges or blocks 13a, 13b have their flat upper surfaces to support the core and their bottom surfaces on which the terminal pins 15a, 15b and 15c, 15d are planted, respectively, so as to extend downward.

The coil supporting portion 11 supports around its outer side a high voltage coil 16, of which opposite ends are anchored on associated ones of the terminal pins 15a through 15d and soldered thereto.

A first outer bobbin 17 has a coil supporting portion 18 being substantially square U-shaped in its cross-section and this coil supporting portion 18 has its inner side formed to receive the pin supporting blocks 13a, 13b of the inner bobbin 10. The coil supporting portion 18 is provided at opposite ends with pin suspporting blocks 19a, 19b serving also as flanges, and in its inner side adjacent longitudinally opposite ends with insertion holes 20a, 20b and 20c, 20d into which the respective terminal pins 15a through 15d can be inserted. The respective insertion holes 20a through 20d have their upper ends somewhat enlarged in diameters with respect to the diameters of the respective terminal pins to formconical shapes. This assures that the pin supporting blocks 13a, 13b are properly received by the inner side of the coil supporting portion 18 even after the high voltage coil 16 has been soldered to the terminal pins 15a through 15d to enlarge the diameters of the respective terminal pins at their bases.

The pin supporting blocks 19a, 19b are provided with the terminal pins 21a, 21b, 21c, 21d, 21e, 21f, 21g, 21h and further provided on the bottom thereof with Planar projections 22a, 22b and cylindrical projections 23a, 23b, 23c, 23d. The respective projections have a same length from the bottom of the pin supporting blocks 19a, 19b so that the respective projections 22a, 22b, 23a, 23b, 23c, 23d bear aainst a print substrate, on which the first outside bobbin 17 has been mounted, and thereby enable the outer bobbin 17 to be positioned. The projections 22a, 22b isolate the respective high voltage terminal pins 15a through 15d, avoiding leak which could otherwise occur among these terminal pins.

The pin supporting blocks 19a, 19b have their upper surfaced formed planar to support the associated core components.

A second outer bobbin 24 has a coil supporting portion 25 subustantially suquare U-shaped in cross-section and the coil supporting portion 25 is provided at opposite ends with square U-shaped flanges 26a, 26b.

The respective flanges 26a, 26b are formed at laterally opposite sides of their lwoer ends with detents 27a, 27b and 27c, 27d adapted to be engaged with the associated notches 14a through 14d of the inner bobbin 10.

The second outside bobbin 24 has its inner side formed to receive the flanges 12a, 12b of the inner bobbin 10.

As will be described later more in detail, central legs 28a, 29a of respective E-core components 28, 29 respectively having a plurality of legs are inserted into the coil supporting portion 11 of the inner bobbin 10 from the opposite ends thereof while right legs 28b, 29b and the left legs 28c, 29c of the respective E-core components 28, 29 are supported on and axially extend inwardly beyond the tops of the respective pin supporting blocks 19a, 19b until the end surfaces of the respective legs about against those of the corresponding legs. The pair of E-core components are bonded together along the corresponding leg end surfaces thereof to establish a magnetic path peculiar to the E—E core configuration.

With the arrangement as has been described, the respective terminal pins 15a through 15d of the inner bobbin 10 around which the high voltage coil 16 has been wound are inserted into the associated insertion holes 20a through 20d and then the lower portions of the pin supporting blocks 13a, 13b of said inner bobbin 10 are received in the inner side of the first outer bobbin 17. Thereafter, the second outer bobbin 24 is mounted on the upper portion of the inner bobbin 10 with the detents 27a through 27d being engaged into the corresponding notches 14a through 14d and with the upper portions of the flanges 12a, 12b of the inner bobbin 10 being received by the inner side of the second outer bobbin 24. Then a low voltage coil 30 is wound around the respective coil supporting portions 18, 25 of the first and second outer bobbins 17, 24, and the ends of this coil 30 thus wound are anchored on any two terminal pins of the terminal pins 21a through 21h and soldered thereto.

Now,the E-core components 28, 29 are assembled to the bobbin/coil assembly from longitudinally opposite sides thereof by sliding the E-core components 28, 29 long the top surfaces of the pin supporting blocks 19a, 19b so that the respective central legs 28a, 29a is inserted into the coil supporting portion 11 of the inner bobbin 10 while the right legs 28b, 29b and the left legs 28c, 29c extend outside the outer bobbins 17, 24. The pair of E-core components 28, 29 are then bonded to each other along the corresponding leg end surfaces to establish a magnetic path.

As will be apparent, this embodiment enables not only so-called lap winding of the high voltage coil 16 and the low voltage coil 30 by use of the inner bobbin 10, the first and second outer bobbins 17, 24 but also reduction in the axial dimensions of the respective bobbins. This contributes to miniaturization of the electric part and facilitates the coil ends to be handled. Additionally, interposition of the insulating outer bobbins 17, 24 between the high voltage coil 16 and the low voltage coil 30 facilitate the inter-coil withstand voltage consideration.

It should be understood that each of the coil supporting portions 11, 18, 25 can be provided with a plurality of coils wound therearound, if desired.

Figure 3:
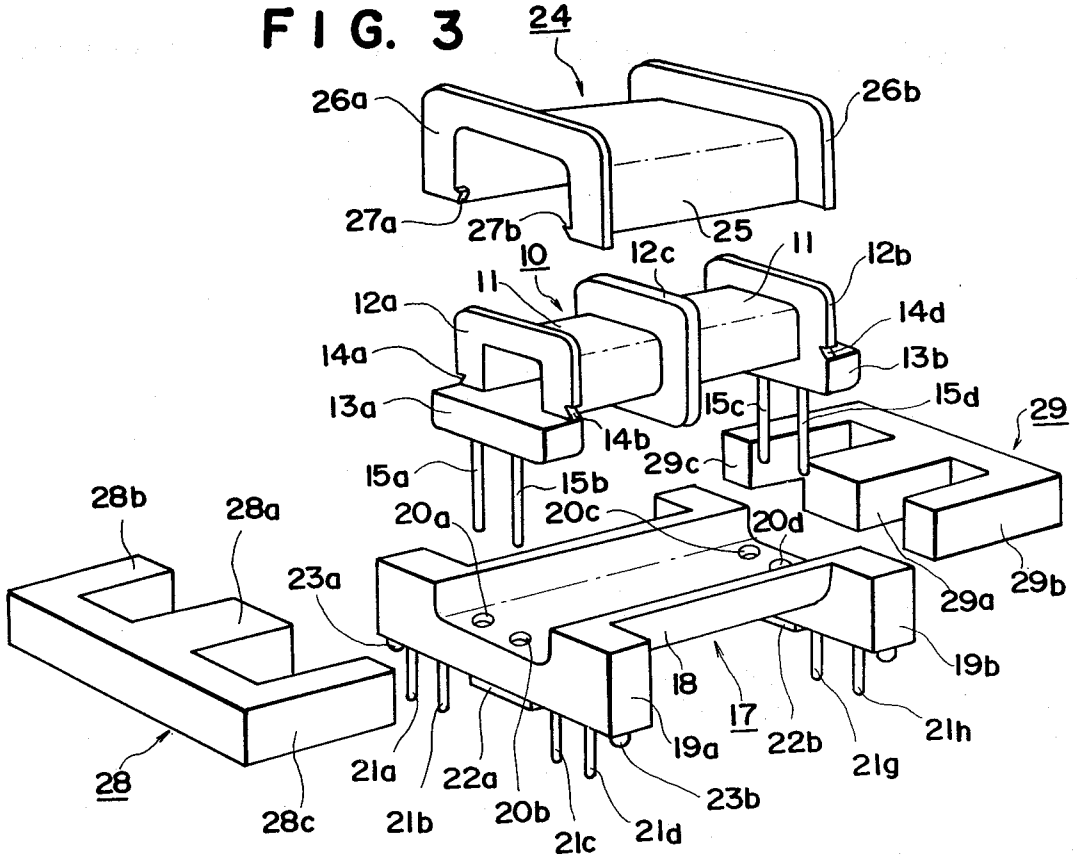
FIG. 3 is an exploded perspective view showing core components and bobbins provided in a compact transformer as a second embodiment of the invention utilizing the E—E core configuration.

When a plurality of different voltage coils around the inner bobbin 10, the coil supporting portion 11 may be provided at longitudinally intermediate position with an additional flange 12c, as shown by FIG. 3 as a second embodiment,to wind two different coils around the coil supporting portion 11.

It should be noted that, in such a case, the ends of the respective coils may be anchored on the respective terminal pins 15a,15b, 15c, 15d and then soldered thereto.

Figure 4:
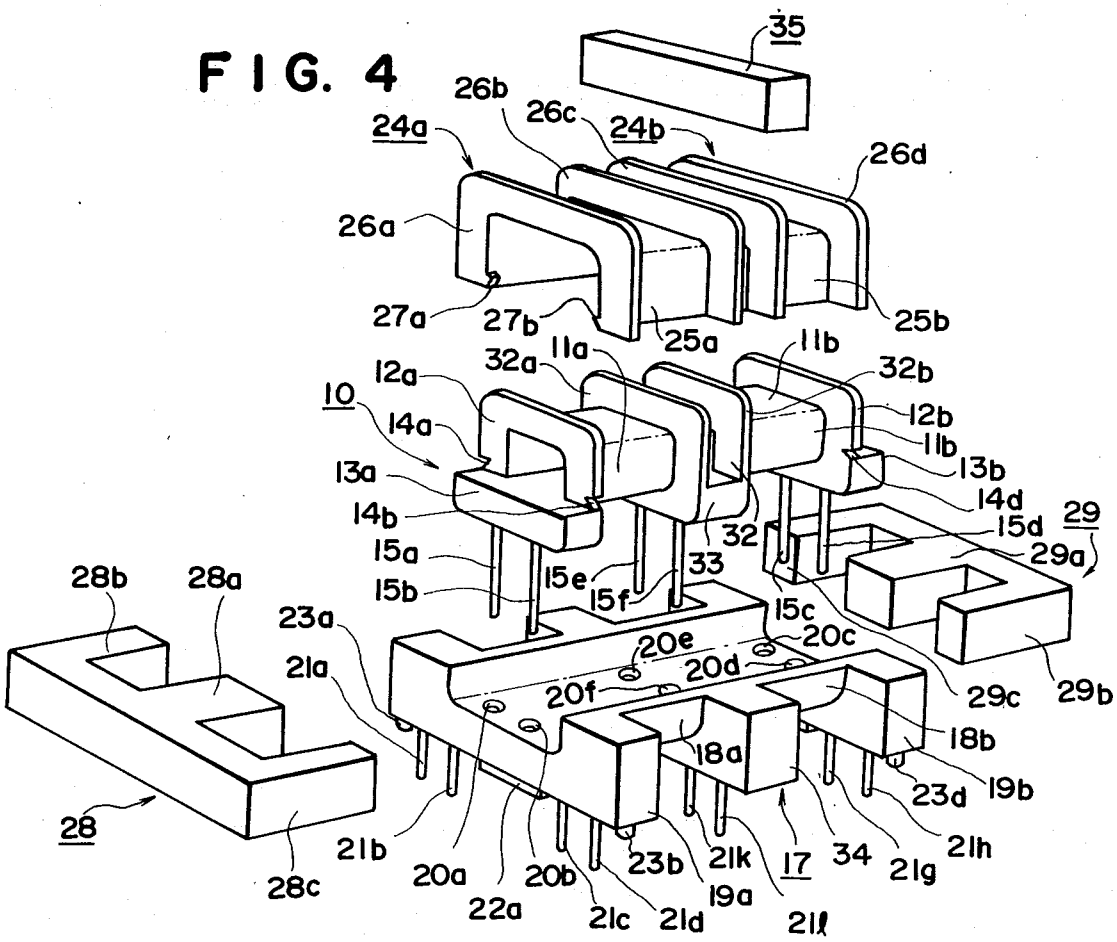
FIG. 4 is an exploded perspective view showing core components and bobbins provided in a compact transformer as a third embodiment of the invention utilizing the E-I-E core configuration.

FIG. 4 shows a third embodiment of the invention utilizing the E-I-E configuration core.

Figure 5:
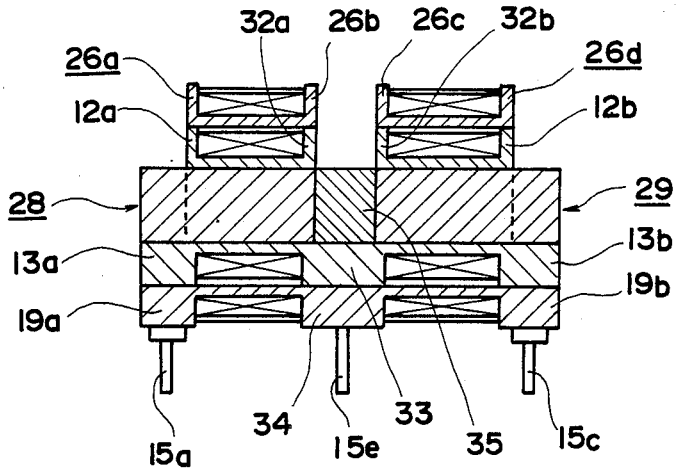
FIG. 5 is a cross-sectional view of this third embodiment.

In this embodiment, as seen in FIGS. 4 and 5, the coil supporting portion 11 of the inner bobbin 10 is formed at its longitudinally intermediate position with an I-core component receiving groove 32 by which the coil supporting portion 11 is divided into two sections 11a, 11b and said core component receiving groove 32 is provided at its longitudinally opposite ends with flanges 32a, 32b which are integrally connected at their bottoms to form a pin supporting block 33 which terminal pins 15*e*, 15*f* are planted so as to extend downward.

The coil supporting portion 18 of the first outer bobbin 17 is formed at its longitudinally intermediate position with a pin supporting block 34 in the form of a thicker flange dividing this coil supporting portion 18 into two sections 18*a*, 18*b*, and terminal pins 21*i*, 21*j*, 21*k*, 21*l* are planted on this pin supporting block 34. The coil supporting portion 18 is further providedin its inner side at a longitudinally intermediate position with terminal pin insertion holes 20*e*, 20*f* in the same manner as the previously mentioned insertion holes 20*a* through 20*d*.

The second outer bobbin 24 is divided, in this embodiment, into subustantially equal outer bobbinsections 24*a*, 24*b* respectively having coil supporting sections 25*a*, 25*b*. The respective coil supporting sections 25*a*, 25*b* are provided at longitudinally opposite ends with square U-shaped flanges 26*a*,26*b* and 26*c*, 26*d*. The previously mentioned core coponent receiving groove 32 is adapted to receive an I-core component 35. Remaining arrangement is identical to that as shown by FIG. 1 and the components which are same as or equivlant to those of FIG. 1 are designated by the similar reference numerals and not further explained.

In this embodiment, the inner bobbin 10 having been provided with respective high voltage coils wound around the coil supporting section 11*a*, 11*b* is received by the inner side of the first outer bobbin 17 and then the second outer bobbin sections 24*a*, 24*b* are mounted over the inner bobbin 10. Now respective low voltage coils are wound around the coil supporting sections 18*a*, 25*a* and 18*b*, 25*b*. After the I-core component 35 has been mounted in the core receiving groove 32, the central legs 28*a*, 29*a* of the respective E-core components 28, 29 are inserted from opposite sides into the coil supporting sections 11*a*, 11*b* of the inner bobbin 10, respectively, so that the outer legs 28*b*, 28*c* and 29*b*, 29*c* of the respective E-core components 28, 29 axially extend along the outsides of the outer bobbin sections 24*a*, 24*b*, respectively.

Figure 8:
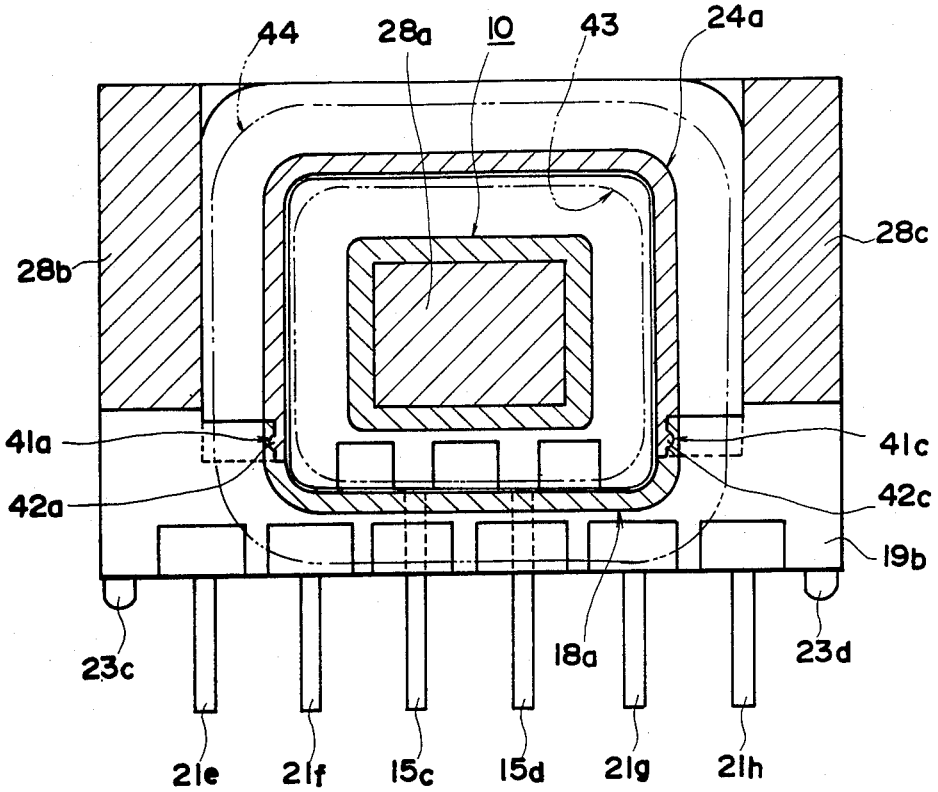
FIG. 8 is an enlarged cross-sectional view of this fourth embodiment.

Then the leg end surfaces of the respective E-core components 28, 29 are adhesively bonded to the I-core component 35 to form a magnetic path as shown by FIG. 8.

This embodiment is characterized in that at least two different high voltage coils can be wound around the inner bobbin 10 and at least two different low voltage coils can be wound around the outer bobbins 17, 24*a*, 24*b*.

Figure 7:
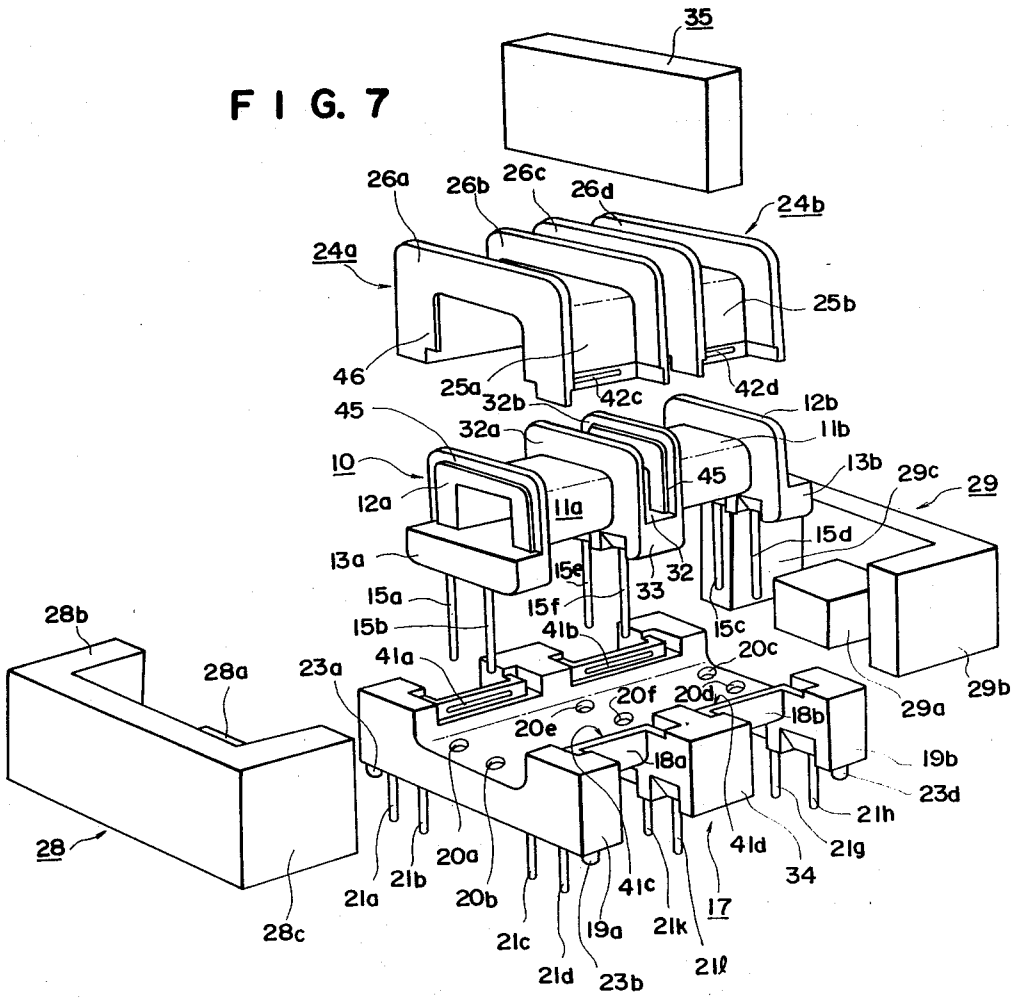
FIG. 7 is an exploded perspective view showing core components and bobbins provided in a compact transformer as a fourth embodiment of the invention utilizing the E-I-E core configuration.

FIG. 7 is an exploded perspective view of core components and bobbins in a compact transformer as a fourth embodiment of the invention and FIG. 8 is an enlarged cross-sectional view of this compact transformer.

Figure 9:
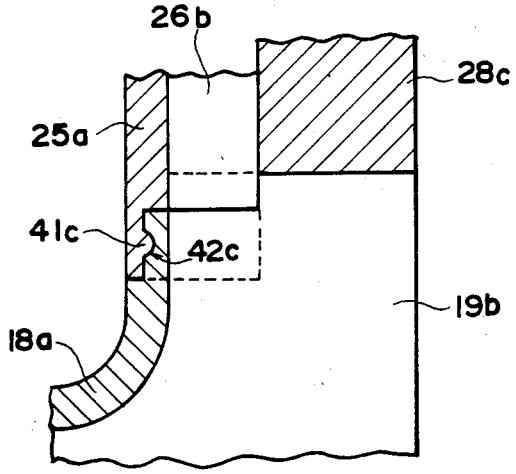
FIG. 9 is an enlarged fragmentary cross-sectional view showing a manner in which the respective bobbins are connected to one another in the fourth embodiment.

In this embodiment, the coil supporting sections 18*a*, 18*b* of the first outer bobbin 17 are provided in its inner surface with horizontally elongate locking recesses 41*a*, 41*b*, 41*c*, 41*d* while the coil supporting sections 25*a*, 15*b* of the second outer bobbin sections 24*a*, 24*b* are provided along their lower edges with horizontally elongate locking ridges 42*a*, 42*b*, 42*c*, 42*d*, so that these locking recesses and ridges are brought into mutual engagement and thereby the first outer bobbin 17 is securely connected to the second bobbin sections 24*a*, 24*b*, as shown by FIG. 8. Referring to FIG. 8, reference numeral 43 designates the high voltage coils and reference numeral 44 designates the low voltage coils. FIG. 9 is a fragmentary cross-sectional view showing, in an enlarged scale, a condition in which the locking recesses have been engaged with locking ridges.

In this embodiment, the respective flanges 12*a*, 12*b* 32*a*, 32*b* of the inner bobbin 10 are provided on their outer surfaces with steps 45 extending along their edges so that corresponding inner edges of the respective flanges provided on the second outer bobbin sections 24*a*, 24*b* are engageable with the respective steps 45. The core components 28, 29 are so configured that the respective central legs 28*a*, 28*a* have rectangular cross-sections which are horizontally elongate and the respective outer legs 28*b*, 28*c*, 29*b*, 29*c* have rectangular cross-sections which are vertically elongate.

Figure 6:
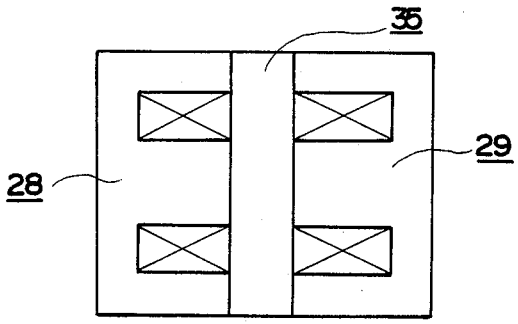
FIG. 6 is a schematic diagram of the core for illustratin of a magnetic path established in the compact transformer as the third embodiment of the invention.

The remaining arrangement is identical to that of the compact transformer as the third embodiment of the invention as shown by FIGS. 4 through 6.

In this embodiment, it is also possible that the locking recesses 41*a* through 41*d* are provided on the second outer bobbin sections 24*a*, 24*b* while the locking ridges 42*a* through 42*d* are provided on the first outer bobbin 17.

Although the present invention has been described by way of example in reference with the accompanying drawings, the E-core components 28, 28, the I-core component 35 and the other components may be implemented in appropriately modified configurations. In such case, it is essential to configure the bobbins in conformity with the core components. It is also optional that the high voltage coil is wound around the outer bobbin while the low voltage coil is wound around the inner bobbin or that the outer and inner bobbins are respectively provided with a plurality of flanges adapted to insulate the different coils wound around the respective coil supporting portions or sections.

Locking means between the first (lower) outer bobbin and the second (upper) outer bobbin are limited neither to the notches 14*a* through 14*d* and the detents 27*a* through 27*d* nor to the locking recesses and the locking ridges, and may rely upon any other locking mechanism or both bobbins may be bonded to each other with adhesive.

What is claimed is:

1. A compact electric part in the form of windings comprising an inner bobbin having a cylindrical coil supporting portion provided at opposit ends with flanges, terminal pins planted on at least one of said flanges and a coil wound around said coil supporting portion; a first outer bobbin having a coil supporting portion substantially square U-shaped in its cross-section with its inner side formed to receive a lower portion of said inner bobbin, said coil supporting portion of said first outer bobbin being provided at opposite ends with flanges and insertion holes into which the respective terminal pins of said inner bobbin are inserted, and terminal pins planted on at least one of the flanges; and a second outer bobbin having a coil supporting portion substantially square U-shaped in cross-section with its inner side formed to receive an upper portion of said inner bobbin, said coil supporting portion of said second outer bobbin being provided at opposite ends with flanges; wherein said inner bobbin around which said coil has been wound is enclosed by said first and second outer bobbins connected to each other, another coil is wound around the respective coil supporting portions of these first and second outer bobbins, and one leg of a core having legs is inserted into an inner cavity of the coil supporting portion of the inner bobbin.

2. A compact electric part in the form of windings as recited in claim 1, wherein thecore having legs comprises a pair of E-core components with their central legs, which form said one leg, are adapted to be inserted form opposite ends of the inner bobbin thereinto.

3. A compact electric part in the form of windings as recited in claim 1, wherein the coil supporting portion of the inner bobbin is provieed at a longitudinally intermediate position with at least one insulating flange.

4. A compact electric part in the form of windings as recited in claim 1, wherein the coil supporting portion of the inner bobbin is provided at a longitudinally intermediate position with an I-core component receiving groove bisecting said coil supporting portion and extending diametrically so said coil supporting portion; said I-core component receiving groove is defined between a pair of flanges provided on said coil supporting portion at opposite sides of said groove; the second outer bobbin is divided into two second outer bobbin sections configured to be received in spaces defined between the flange of said inner bobbin one end thereof and the adjacent flange of said core component receiving groove and between the flange of said inner bobbin on the other end thereof and the adjacent flange of said core component receiving groove, respectively; an I-core component is mounted in said core component receiving groove of the inner bobbin; and said one leg of the core having legs is inserted into the coil supporting portion of said inner bobbin and then said core having legs is connected to said I-core component.

5. A compact electric part in the form of windings as recited in claim 4, wherein said part includes a single said I-core component and the core is formed from a pair of E-core components.

* * * * *